US010087870B2

(12) United States Patent
Imai et al.

(10) Patent No.: US 10,087,870 B2
(45) Date of Patent: Oct. 2, 2018

(54) FUEL INJECTION CONTROLLER AND FUEL INJECTION SYSTEM

(71) Applicant: DENSO CORPORATION, Kariya, Aichi-pref. (JP)

(72) Inventors: Keita Imai, Kariya (JP); Eiji Ito, Anjo (JP)

(73) Assignee: DENSO CORPORATION, Kariya (JP)

( * ) Notice: Subject to any disclaimer, the term of this patent is extended or adjusted under 35 U.S.C. 154(b) by 900 days.

(21) Appl. No.: 14/071,200

(22) Filed: Nov. 4, 2013

(65) Prior Publication Data

US 2014/0123960 A1 May 8, 2014

(30) Foreign Application Priority Data

Nov. 5, 2012 (JP) ..... 2012-243626

(51) Int. Cl.

*F02M 51/00* (2006.01)
*F02D 41/30* (2006.01)
*F02D 41/20* (2006.01)
*F02D 41/08* (2006.01)

(52) U.S. Cl.

CPC ..... *F02D 41/30* (2013.01); *F02D 41/20* (2013.01); *F02D 41/08* (2013.01); *F02D 2041/2006* (2013.01); *F02D 2041/2058* (2013.01)

(58) Field of Classification Search

USPC ..... 123/490
See application file for complete search history.

(56) References Cited

U.S. PATENT DOCUMENTS 4,922,878 A 5/1990 Shinogle et al.
5,231,962 A * 8/1993 Osuka ..... F02D 41/062 123/179.16

(Continued)

FOREIGN PATENT DOCUMENTS

JP 2001-182593 7/2001
JP 2005-330934 12/2005

(Continued)

OTHER PUBLICATIONS

Office Action (3 pages) dated Nov. 4, 2014, issued in corresponding Japanese Application No. 2012-243626 and English translation (3 pages).

(Continued)

*Primary Examiner* — Lindsay Low
*Assistant Examiner* — Ruben Picon-Feliciano
(74) *Attorney, Agent, or Firm* — Nixon & Vanderhye PC

(57) ABSTRACT

A fuel injection controller is applied to a fuel injector injecting fuel to be combusted in an internal combustion engine by an open-valve operation of the valve body according to an electromagnetic suction force generated by an energization of a coil. The fuel injection controller controls an injection state of the fuel injector by controlling a coil current flowing through the coil. The fuel injection controller includes an increasing control portion which increases the coil current to a first target value, a holding control portion which holds the coil current increased by the increasing control portion to the first target value, and a changing portion which changes the first target value according to the operation state of the internal combustion engine.

24 Claims, 7 Drawing Sheets

(56) References Cited

U.S. PATENT DOCUMENTS

| | | | | |
|---|---|---|---|---|
| 5,992,391 | A * | 11/1999 | Yamakado | F02D 41/20 123/490 |
| 6,571,773 | B1 * | 6/2003 | Yamakado | F02D 41/20 123/486 |
| 6,981,663 | B2 | 1/2006 | Fukutomi | |
| 9,228,521 | B2 * | 1/2016 | Imai | F02D 41/20 |
| 2002/0014223 | A1 | 2/2002 | Marceca et al. | |
| 2005/0072950 | A1 * | 4/2005 | Tojo | H01F 41/0246 251/129.15 |
| 2010/0263632 | A1 | 10/2010 | Miyake et al. | |
| 2011/0220067 | A1 * | 9/2011 | Okonogi | F02D 41/20 123/480 |
| 2011/0222202 | A1 * | 9/2011 | Onda | F02D 41/20 361/152 |
| 2012/0067329 | A1 * | 3/2012 | Bunni | F02D 41/20 123/490 |
| 2012/0194961 | A1 | 8/2012 | Yamada et al. | |
| 2012/0216783 | A1 * | 8/2012 | Kusakabe | F02D 41/20 123/490 |
| 2014/0117121 | A1 * | 5/2014 | Nong | F02M 51/061 239/584 |

FOREIGN PATENT DOCUMENTS

| | | |
|---|---|---|
| JP | 2008-069682 | 3/2008 |
| JP | 2011-032922 | 2/2011 |
| JP | 4876174 | 12/2011 |
| JP | 2012-167561 | 9/2012 |
| WO | WO 2009/154214 | 12/2009 |

OTHER PUBLICATIONS

Office Action (10 pgs.) dated May 18, 2015 issued in co-pending U.S. Appl. No. 14/071,228.
Imai, U.S. Appl. No. 14/071,228, filed Nov. 4, 2013.
Imai, U.S. Appl. No. 14/070,670, filed Nov. 4, 2013.

* cited by examiner

Uboost
VOLTAGE
Ubatt
0
t10
Tpickup
Tboost
t13
t14
t20
Ti
t30
t40
t41
t11
t12
TIME (ms)

COIL CURRENT
0
IH1
Ihold1
IL1
ΔI
IH2
Ihold2
IL2
IH3
Ihold3
IL3
TIME (ms)

SUCTION FORCE
0
Fa
Fb
ΔF
TIME (ms)

LIFT AMOUNT
0
ta
tb
tc
td
Lmax
tah
Tact
TIME (ms)

VOLTAGE
t10
t20
t30
t40
TIME (ms)

COIL CURRENT
Ipeak
Ihold
TIME (ms)

SUCTION FORCE
ΔF
TIME (ms)

Qi
t10
ta
TIME (ms)

VOLTAGE
t10
t11
t13
t40
TIME (ms)

COIL CURRENT
t11s
t11r
Ihold1
Ihold2
TIME (ms)

SUCTION FORCE
ΔFs
Fa
ΔFr
TIME (ms)

Qi
t10
tas
ta
tar
t10b
Δqs
Δqr
TIME (ms)

FUEL INJECTION CONTROLLER AND FUEL INJECTION SYSTEM

CROSS-REFERENCE TO RELATED APPLICATION

This application is based on Japanese Patent Application No. 2012-243626 filed on Nov. 5, 2012, the disclosure of which is incorporated herein by reference.

TECHNICAL FIELD

The present disclosure relates to a fuel injection controller and a fuel injection system. In the fuel injection controller or the fuel injection system, an injection state of fuel such as an injection start time point or an injection amount is controlled by controlling an energization of a coil of a fuel injector.

BACKGROUND

JP-2012-177303A (US2012/0216783A1) describes that a controller relates to a fuel injector injecting fuel by a lift-up (open-valve operation) of the valve body according to an electromagnetic force (suction force) generated by an energization of a coil. An opening time point of the valve body and an opening time period are controlled by controlling an energization start time point of the coil and an energization time period of the coil, and then an injection start time point and an injection amount are controlled.

As shown in FIG. 6, a voltage apply of the coil is continued from a time point that the energization of the coil is started to a time point that a coil current reaches a target peak value Ipeak. The target peak value represents a necessary value for opening the valve body.

When the valve body is opened, a current for holding this opening state is less than the target peak value. Specifically, when the suction force is increased, the suction force is affected by inductance due to a large variation in magnetic field. When the suction force is held to a specified value, the suction force is not affected by inductance.

Thus, at a time point that the coil current reaches the target peak value, a duty control applies voltage to the coil to decrease the coil current so that the coil current is held to a holding value Ihold which is less than the target peak value.

According to the duty control, as shown in FIG. 6, the suction force is increased synchronously with an increase in coil current. Thus, the valve body is opened. After the coil current reaches the target peak value, the suction force is decreased synchronously with a decrease in coil current. In this case, the coil current is decreased to the holding value Ihold.

SUMMARY

It is preferable that an increasing rate of the suction force is varied according to an operation state of an internal combustion engine. For example, when a delay time period from a time point that the energization is started to a time point that the valve body is started to be opened is necessary to be shortened, the increasing rate of the suction force may be raised. Alternatively, when an increasing rate of a movable core moving together with the valve body is lowered to reduce a collision sound caused where the movable core is collided with a fixed core, the increasing rate of the suction force may be lowered.

However, since the increasing rate of the suction force can be changed only by a voltage applied to the coil or a resistance of the coil, it is difficult to vary the voltage or the resistance according to the operation state.

The present disclosure is made in view of the above matters, and it is an object of the present disclosure to provide a fuel injection controller and a fuel injection system. In the fuel injection controller and the fuel injection system, an increasing rate of an electromagnetic force can be changed readily.

According to an aspect of the present disclosure, a fuel injection controller is applied to a fuel injector injecting fuel to be combusted in an internal combustion engine by an open-valve operation of the valve body according to an electromagnetic suction force generated by an energization of a coil. The fuel injection controller controls an injection state of the fuel injector by controlling a coil current flowing through the coil.

The fuel injection controller includes an increasing control portion which increases the coil current to a first target value, a holding control portion which holds the coil current increased by the increasing control portion to the first target value, and a changing portion which changes the first target value according to the operation state of the internal combustion engine.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
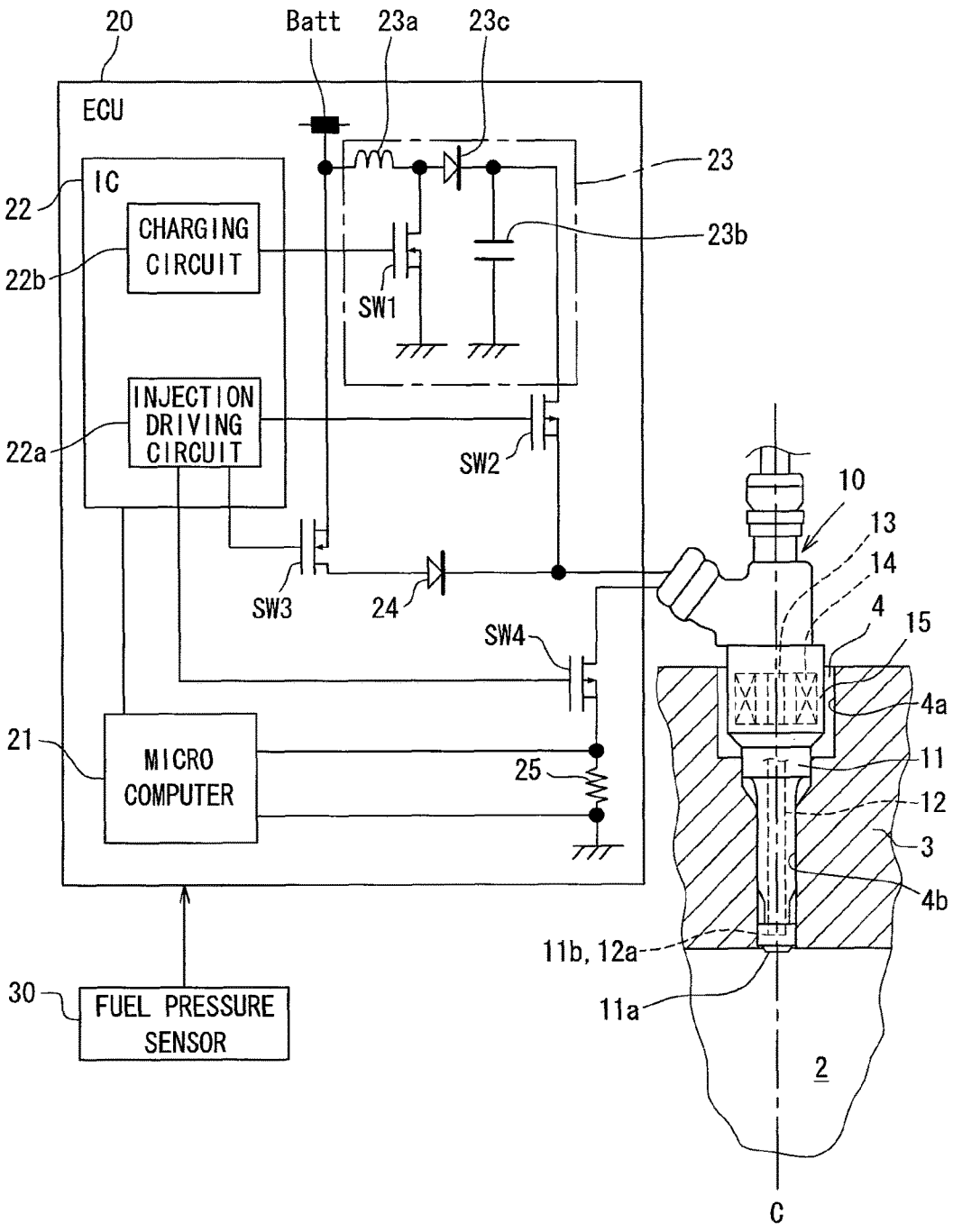
FIG. 1 is a block diagram showing a fuel injection controller according to an embodiment of the present disclosure.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Hereafter, a fuel injection controller according to an embodiment of the present disclosure will be described referring to drawings.

As shown in FIG. 1, a fuel injector 10 is mounted on an internal combustion engine of an ignition type, and directly injects fuel into a combustion chamber 2 of the internal combustion engine. For example, the internal combustion engine may be a gasoline engine. Specifically, an attachment hole 4 for the fuel injector 10 to be inserted into is axially provided in a cylinder head 3 along a center line LC of a cylinder.

The fuel injector 10 includes a fuel passage therein and a body 11 having an injection port 11*a* for injecting fuel. A valve body 12, a movable core (not shown), and a fixed core 13 are accumulated in the body 11. The valve body 12 has a seal surface 12*a* for seating or leaving a seat surface 11*b* of the body 11. When the valve body 12 is closed so that the seal surface 12*a* is seated on the seat surface 11*b*, a fuel injection from the injection port 11*a* is stopped. When the valve body 12 is opened (lift-up) so that the seal surface 12*a* is left the seat surface 11*b*, fuel is injected from the injection port 11*a*.

The fixed core 13 is formed by winding a first coil 14 around a bobbin, and is covered b a housing 15. The housing 15, the fixed core 13, and the body 11, which are made of magnetic material, form a magnetic passage for a magnetic flux generated by an energization of the first coil 14. When the first coil 14 is energized, a magnetic force (suction force) is generated. Thus, the movable core is biased to the fixed core 13 by the magnetic force to be lift-up. The valve body 12 connecting with the movable core is lift-up along with the movable core. When the first coil 14 is deenergized, the valve body 12 is closed along with the movable core by an elastic force of a spring (not shown).

As shown in FIG. 1, the entire or a part of the housing 15 accumulating the first coil 14 is surrounded over the whole circumference by a first interior circumference surface 4*a* of the attachment hole 4. A second interior circumference surface 4*b* of the attachment hole 4 contacts an exterior circumference surface of a magnetic circuit portion. The magnetic circuit portion is placed at position of the body 11 closer to the injection port 11*a* than the housing 15. A clearance is formed between an exterior circumference surface of the housing 15 and the first interior circumference surface 4*a*. That is, the exterior circumference surface of the housing 15 and the first interior circumference surface 4*a* are opposite to each other with a clearance.

An electronic control unit (ECU) 20 includes a microcomputer 21, an integrated circuit (IC) 22, a boost circuit 23, and switching elements SW2, SW3 and SW4. The microcomputer 21 consists of a center processing unit (CPU), a nonvolatile memory (ROM), and a volatile memory (RAM). The microcomputer 21 computes a target injection amount and a target injection start time point based on a load of the internal combustion engine and an engine speed. A pressure (fuel pressure) Pc of a fuel supplied to the fuel injector 10 is detected by a fuel pressure sensor 30. The microcomputer 21 may correct the target injection amount and the target injection start time point, according to the fuel pressure Pc.

Figures 6A, 6B, 6C, 6D, 6E, 6F, 6G, 6H:
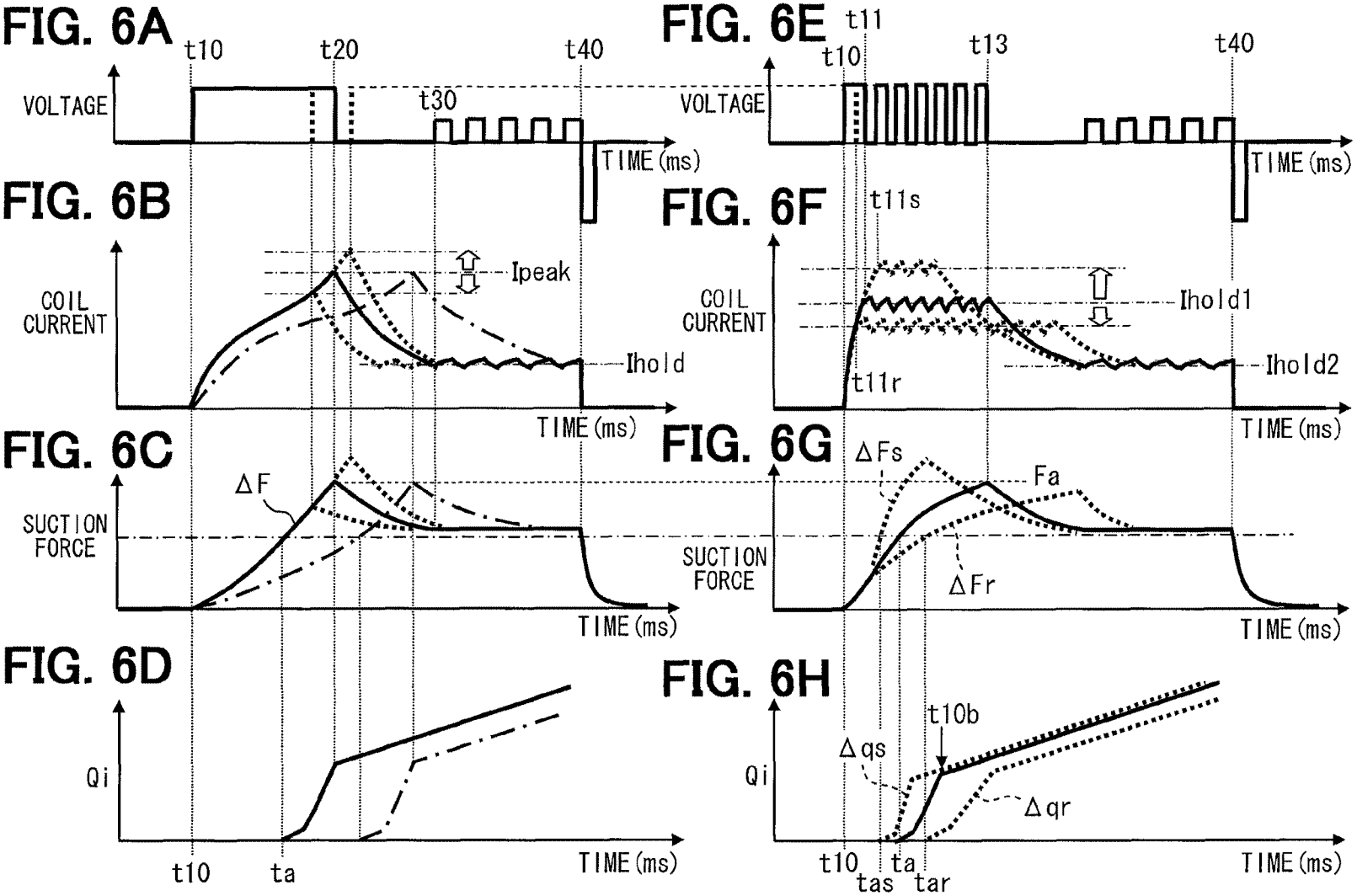
FIG. 6A is a graph showing a variation in voltage where a target peak value Ipeak is varied according to a conversional control.
FIG. 6B is a graph showing a variation in current where a target peak value Ipeak is varied according to a conversional control.
FIG. 6C is a graph showing a variation in suction force where a target peak value Ipeak is varied according to a conversional control.
FIG. 6D is a graph showing a variation in q where a target peak value Ipeak is varied according to a conversional control.
FIG. 6E is a graph showing a variation in voltage where a first target value Ihold1 is varied according to the embodiment.
FIG. 6F is a graph showing a variation in current where the first target value Ihold1 is varied according to the embodiment.
FIG. 6G is a graph showing a variation in suction force where the first target value Ihold1 is varied according to the embodiment.
FIG. 6H is a graph showing a variation in q where the first target value Ihold1 is varied according to the embodiment.

The injection amount Qi is controlled by controlling an energization time period Ti of the first coil 14 according to an injection characteristic shown in FIG. 6H. A first time point t10 represents the energization start time point. A second time point t10*b* represents a max opening degree time point that an opening degree of the injection port 11*a* becomes its maximum. In this case, the movable core contacts the fixed core 13, and a lift amount of the valve body 12 becomes its maximum. An injection area, where the valve body 12 is closed before the max opening degree time point t10*b*, is referred to as a micro injection area.

The IC 22 includes an injection driving circuit 22*a* and a charging circuit 22*b*. The injection driving circuit 22*a* controls the switching elements SW2, SW3, and SW4. The charging circuit 22*b* controls the boost circuit 23. The injection driving circuit 22*a* and the charging circuit 22*b* are operated according to an injection command signal outputted from the microcomputer 21. The injection command signal, which is a signal for controlling an energizing state of the first coil 14, is set by the microcomputer 21 based on the target injection amount, the target injection start time point, and a coil circuit value I. The injection command signal includes an injection signal, a boost signal, and a battery signal.

The boost circuit 23 includes a second coil 23*a*, a condenser 23*b*, a first diode 23*c*, and a first switching element SW1. When the charging circuit 22*b* controls the first switching element SW1 to repeatedly be turned on or turned off, a battery voltage applied from a battery terminal Batt is boosted (boosted) by the second 23*a*, and is accumulated in the condenser 23*b*. In this case, the battery voltage after being boosted and accumulated corresponds to a boost voltage.

When the injection driving circuit 22*a* turns both a second switching element SW2 and a fourth switching element SW4 on, the boost voltage is applied to the first coil 14. When the injection driving circuit 22*a* turns both a third switching element SW3 and the fourth switching element SW4 on, the battery voltage is applied to the first coil 14. When the injection driving circuit 22*a* turns the switching elements SW2, SW3 and SW4 off, no voltage is applied to the first coil 14. When the second switching element SW2 is turned on, a second diode 24 shown in FIG. 1 is for preventing the boost voltage from being applied to the third switching element SW3.

A shunt resistor 25 is provided to detect a current flowing through the fourth switching element SW4, that is, the shunt resistor 25 is provided to detect a current (coil current) flowing through the first coil 14. The microcomputer 21 computes the coil current value I based on a voltage decreasing amount according to the shunt resistor 25.

Figure 2:
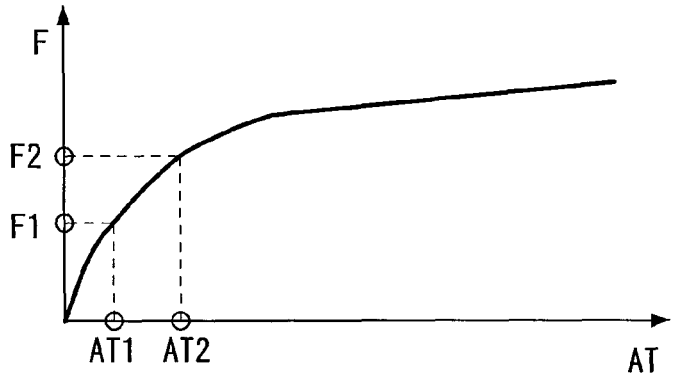
FIG. 2 is a graph showing a relationship between an ampere turn and an electromagnetic force.
Figure 3:
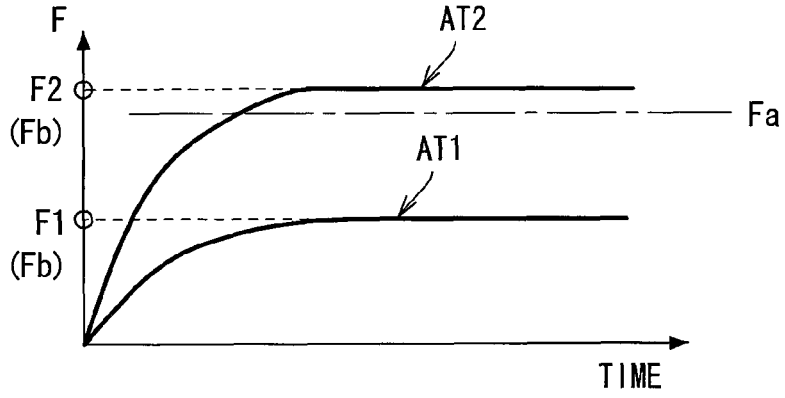
FIG. 3 is a graph showing a relationship between time, the electromagnetic force, and the ampere turn.

Hereafter, the suction force F which suctions the movable core will be described. As shown in FIG. 2, the suction force F is increased in accordance with an increase in magnetomotive force (ampere turn AT) generated in the fixed core 13. Specifically, in a condition where a number of turns of the first coil 14 is fixed, a first ampere turn AT1 is less than a second ampere turn AT2, and a first suction force F1 is less than a second suction force F2. As shown in FIG. 3, an increasing time period is necessary for the suction force F to be saturated and become the maximum since the first coil 14 is energized. According to the embodiment, the maximum of the suction force F is referred to as a static suction force Fb.

In addition, the suction force F for opening the valve body 12 is referred to as a required opening force. The required opening force is increased in accordance with an increase in pressure of the fuel supplied to the fuel injector 10. Further, the required opening force may be increased according to various conditions such as an increase in viscosity of fuel. The required opening force of when it is necessary to be a value large enough is referred to as a required force Fa.

Figures 4A, 4B, 4C, 4D:
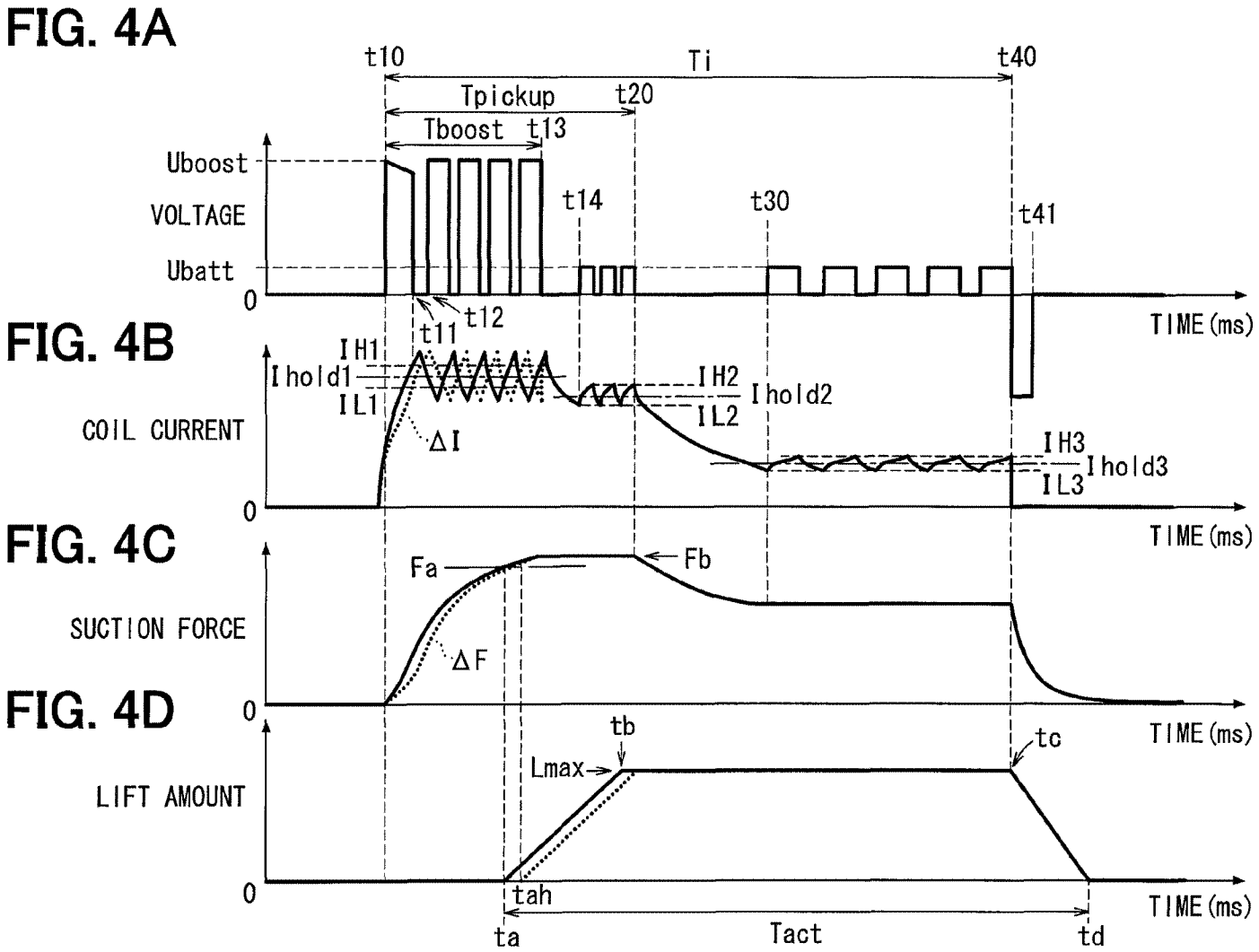
FIG. 4A is a graph showing a relationship between a voltage applied to a coil and time.
FIG. 4B is a graph showing a relationship between a coil current and time.
FIG. 4C is a graph showing a relationship between the electromagnetic force and time.
FIG. 4D is a graph showing a relationship between a lift amount and time.

FIG. 4A is a graph showing a waveform of a voltage applied to the first coil 14 in a case where the fuel injection is executed once. At the first time point t10, the boost voltage Uboost is applied to the first coil 14 so that the first coil 14 is started to be energized. As shown in FIG. 4B, the coil current is increased to a first target value Ihold1 since the first time point t10. Then, at a time point t11 that the coil current is increased to a first upper limit IH1 greater than the first target value Ihold1, the first coil 14 is deenergized. Then, the coil current is started to be decreased.

Figure 5:
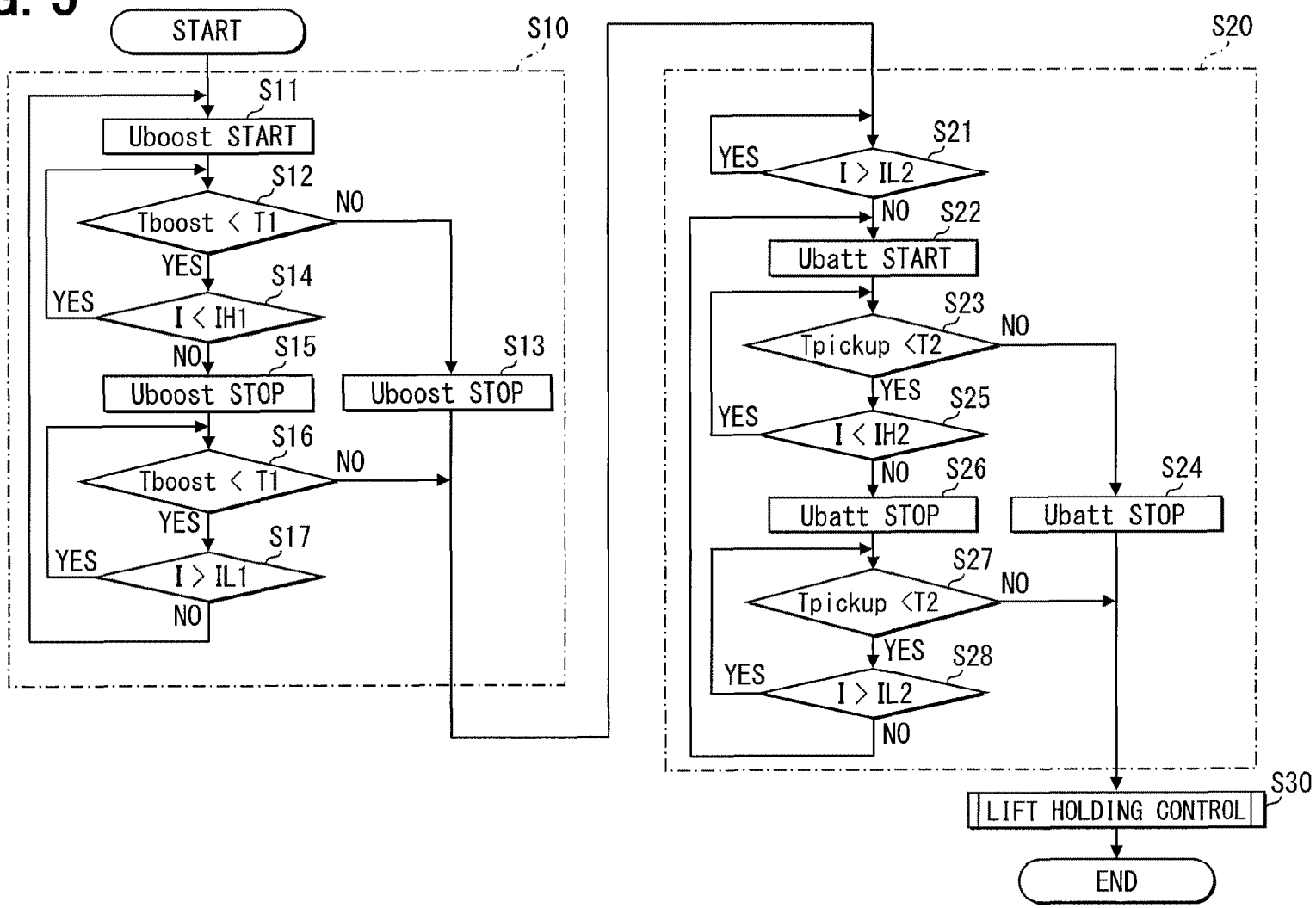
FIG. 5 is a flowchart showing an injection control executed by a microcomputer of the fuel injection controller.

As shown in FIG. 5, at S11 and S14, the coil current is controlled to be increased to the first target value Ihold1 by the boost voltage Uboost applied to the first coil 14 for the first time. The processing in S11 and S14 may correspond to an increasing control portion which executes an increasing control to control the coil current. A first energization time period of the increasing control is referred to as a first current increasing period which is a time period from the first time point t10 to a time point t11 shown in FIG. 4A. The first target value Ihold1 is set to a value so that the static suction force Fb is greater than or equal to the required force Fa, as shown in FIG. 4C.

As shown in FIGS. 4A and 4B, at a time point t12 that the coil current is decreased to a first lower limit IL1 less than the first target value Ihold1, the first coil 14 is energized again by the boost voltage Uboost. Then, the coil current is started to be increased again. As the above description, the coil current is energized or deenergized by turns from the first time point t10.

As shown in FIGS. 5, at S11, S14, S15 and S17, the coil current is controlled by the boost voltage Uboost so that an average value of the coil current is held to the first target value Ihold1. The processing in S11, S14, S15 and S17 may correspond to a holding control portion which executes a first duty control (holding control) in which an on-off energization of the boost voltage Uboost is repeated since the time point t12 to hold the coil current. As shown in FIG. 4A, the holding control is stopped at a time point t13 that a first elapsed time period Tboost reaches a first predetermined time period T1 since the first time point t10. Then, the coil current may be started to be decreased. An on-off energization time period of the holding control is referred to as a current holding period which is a time period from the time point t11 to the time point t13 shown in FIG. 4A.

As shown in FIGS. 4A and 4B, at a time point t14 that the coil current is decreased to a second lower limit IL2 less than a second target value Ihold2, the first coil 14 is energized by being applied from the battery voltage Ubatt. Then, the coil current is started to be increased. At a time point that the coil current is increased to a second upper limit IH2 greater than the second target value Ihold2, the first coil 14 is deenergized. Then, the coil current is started to be decreased. The coil current is energized or deenergized by turns from the time point t14.

As shown in FIG. 5, at S22, S25, S26 and S28, the coil current is controlled by the battery voltage Ubatt so that the average value of the coil current is held to the second target value Ihold2. The processing in S22, S25, S26 and S28 may correspond to a battery holding control portion which executes a second duty control (battery holding control) in which an on-off energization of the battery voltage is repeated since the time point t14 to hold the coil current. As shown in FIG. 4A, the battery holding control is stopped at a time point t20 that a second elapsed time period Tpickup reaches a second predetermined time period T2 since the first time point t10. Then, the coil current may be started to be decreased. An on-off energization time period of the battery holding control is referred to as a battery holding period which is a time period from the time point t14 to a time point t20 shown in FIG. 4A. The second target value Ihold2 is set to a value where the electromagnetic force which is increased by the increasing control and the holding control can be held.

As shown in FIG. 4B, the second target value Ihold2 is set to a value less than the first target value Ihold1. According to the present disclosure, the second target value Ihold2 may be set to a value equal to the first target value Ihold1.

The first upper limit IH1, the first lower limit IL1, the second upper limit IH2, and the second lower limit IL2 are set so that a variable frequency of the coil current in the current holding period is greater than that in the battery holding period.

As shown in FIG. 4B, an increasing slope of the coil current of when the boost voltage Uboost is applied to the first coil 14 is greater than that of when the battery voltage Ubatt is applied to the first coil 14. As shown in FIG. 4B, the first upper limit IH1, the first lower limit IL1, the second upper limit IH2, and the second lower limit IL2 are set so that a first difference ΔI1 between the first upper limit IH1 and the first lower limit IL1 is equal to a second difference ΔI2 between the second upper limit IH2 and the second lower limit IL2. Thus, the variable frequency in the current holding period is greater than that in the battery holding period. For example, when the second target value Ihold2 is set to a value equal to the first target value Ihold1, the first upper limit IH1 is set to be equal to the second upper limit IH2, and the first lower limit IL1 is set to be equal to the second lower limit IL2, so that the first difference ΔI1 is equal to the second difference ΔI2.

As shown in FIGS. 4A and 4B, at a time point t30 that the coil current is decreased to a third lower limit IL3 less than a third target value Ihold3, the first coil 14 is energized by being applied from the battery voltage Ubatt. Then, the coil current is started to be increased. At a time point that the coil current is increased to a third upper limit IH3 greater than the third target value Ihold3, the first coil 14 is deenergized.

Then, the coil current is started to be decreased. The coil current is energized or deenergized by turns from the time point t30.

In a third duty control (lift holding control), the on-off energization of the battery voltage Ubatt is repeated since the time point t30 to hold the coil current. The lift holding control is stopped by the injection command signal at an energization complete time point t40.

The injection signal of the injection command signal is a pulse signal dictating to the energization time period Ti. A pulse-on time point of the injection signal is set to the first time point t10 by an injection delay time earlier than the target energization start time point ta. A pulse-off time point of the injection signal is set to the energization complete time point t40 after the energization time period Ti has elapsed since the first time point t10. The fourth switching element SW4 is controlled by the injection signal.

The boost signal of the injection command signal is a pulse signal dictating to an energization state of the boost voltage Uboost. The boost signal has a pulse-on time point as the same as the pulse-on time point of the injection signal. The boost signal is repeated to be turned on or turned off so that the coil current value I is held to the first target value Ihold1 during the first elapsed time period Tboost reaches the first predetermined time period T1 since the first time point t10. The second switching element SW2 is controlled by the boost signal.

The battery signal of the injection command signal is a pulse signal having a pulse-on time point that the first elapsed time period Tboost reaches the first predetermined time period T1 since the first time point t10. Then, the battery signal is repeated to be turned on or turned off so that the coil circuit value I is feedback controlled and held to the second target value Ihold2, until a time point that the second elapsed time period Tpickup reaches the second predetermined time period T2 since the first time point t10. Then, the battery signal is repeated to be turned on or turned off so that the coil circuit value I is feedback controller and held to the third target value Ihold3, until a time point that the injection signal is turned off. The third switching element SW3 is controlled by the battery signal.

The microcomputer 21 outputs the boost signal and the battery signal according to the flowchart shown in FIG. 5. Processings shown in FIG. 5 are executed repeatedly at a predetermined period after the pulse-on time point of the injection signal. As shown in FIG. 5, the increasing control and the holding control are executed according to the processings in S10, the battery holding control is executed according to the processings in S20, and the lift holding control is executed according to the processings in S30.

At S11, the boost signal is turned on such that the boost voltage Uboost is started to be applied to the first coil 14. Then, the boost signal is continuously turned on to apply the boost voltage Uboost to the first coil 14 until the microcomputer 21 determines that the coil current value I reaches the first upper limit IH1 (S14: No). The first upper limit IH1 is set to a value by a predetermined amount greater than the first target value Ihold1. Therefore, the coil current is increased to the first target value Ihold1 in the increasing control, according to the boost voltage applied to the first coil 14 for the first time.

When the first elapsed time period Tboost reaches the first predetermined time period T1 since the first time point t10 (S12: No) due to abnormality before the coil current value I becomes equal to the first upper limit IH1, the microcomputer 21 proceeds to S13. At S13, the microcomputer 21 turns off the boost signal so that the boost voltage Uboost is stopped from being applied to the first coil 14. When the microcomputer 21 determines that the coil current value I is greater than or equal to the first upper limit IH1 (S14: No), the microcomputer 21 proceeds to S15. At S15, the boost voltage Uboost is stopped from being applied to the first coil 14. Then, the increasing control is completed.

When the first elapsed time period Tboost is less than the first predetermined time period T1 (S16: Yes), the boost signal is continuously turned off such that the boost voltage Uboost is stopped from being applied to the first coil 14, until the microcomputer 21 determines that the coil current value I is decreased to the first lower limit IL1 (S17: No). The first lower limit IL1 is set to a value by a predetermined amount less than the first target value Ihold1.

When the microcomputer 21 determines that the coil current value I is less than or equal to the first lower limit IL1 (S17: No), the microcomputer 21 returns to S11. At S11, the boost signal is turned on again such that the boost voltage Uboost is restarted to be applied to the first coil 14. Thus, the boost signal is controlled to be turned on or turned off by the first upper limit IH1 and the first lower limit ILI as thresholds, until the microcomputer 21 determines that the first elapsed time period Tboost is greater than or equal to the first predetermined time period T1 after the increasing control is completed (S12: No, S16: No). As the above description, in the holding control, an average value of the coil current is held to the first target value Ihold1.

When the microcomputer 21 determines that the first elapsed time period Tboost is greater than or equal to the first predetermined time period T1 (S12: No, S16: No), the boost voltage Uboost is continuously stopped from being applied to the first coil 14, until the microcomputer 21 determines that the coil current value I is decreased to the second lower limit IL2 (S21: No). The second lower limit IL2 is set to a value by a predetermined amount less than the second target value Ihold2. As shown in FIG. 4, the second target value Ihold2 is set to a value less than the first target value Ihold1. According to the present disclosure, the second target value Ihold2 may be set to a value equal to the first target value Ihold1.

When the microcomputer 21 determines that the coil current value I is less than or equal to the second lower limit IL2 (S21: No), the microcomputer 21 proceeds to S22. At S22, the battery signal is turned on such that the battery voltage Ubatt is started to be applied to the first coil 14. Then, the battery signal is continuously turned on to apply the battery voltage Ubatt to the first coil 14 until the microcomputer 21 determines that the coil current value I reaches the second upper limit IH2 (S25: No). The second upper limit IH2 is set to a value by a predetermined amount greater than the second target value Ihold2.

When the microcomputer 21 determines that the coil current value I is greater than or equal to the second upper limit IH2 (S25: No), the microcomputer 21 proceeds to S26. At S26, the battery voltage Ubatt is stopped from being applied to the first coil 14. When the microcomputer 21 determines that the coil current value I is less than or equal to the second lower limit IL2 (S28: No), the microcomputer 21 returns to S22. At S22, the battery signal is turned on again such that the battery voltage Ubatt is restarted to be applied to the first coil 14. Thus, the battery signal is controlled to be turned on or turned off by the second upper limit IH2 and the second lower limit IL2 as thresholds, until the microcomputer 21 determines that the second elapsed time period Tpickup becomes equal to the second predetermined time period T2 after the holding control is completed (S23: No, S27: No). As the above description, in the battery holding control, an average value of the coil current is held to the second target value Ihold2.

When the microcomputer 21 determines that the second elapsed time period Tpickup is greater than or equal to the second predetermined time period T2 (S23: No, S27: No), the microcomputer 21 terminates the battery holding control, turns off the battery signal at S24 or S26, and then proceeds to S30. At S30, the microcomputer 21 turns on or turns off the battery signal so that the coil current value I varies within thresholds from the third lower limit IL3 to the third upper limit IH3. As the above description, in the lift holding control, an average value of the coil current is held to the third target value Ihold3.

In addition, the third upper limit IH3 is set to a value by a predetermined amount greater than the third target value Ihold3, and the third lower limit IL3 is set to a value by a predetermined amount less than the third target value Ihold3. The third target value Ihold3 is set to a value less than the second target value Ihold2.

Hereafter, an operation of the fuel injector 10 according to the above-mentioned various controls will be described in reference with FIGS. 4C and 4D. FIG. 4C is a graph showing a relationship between the suction force F and time, and FIG. 4D is a graph showing a relationship between the lift amount and time.

As shown in FIG. 4C, when the increasing control is started, the suction force F is started to be increased. The suction force F is continuously increased even after the increasing control is completed. During the current holding period where the holding control is executed, the suction force F reaches the required force Fa. As shown in FIG. 4D, the seal surface 12*a* is detached from the seat surface 11*b* such that an open-valve operation (lift-up) is started, at a time point that the suction force F becomes the required force Fa.

When the coil current is held to the first target value Ihold1 by the holding control, the suction force F is increased to the static suction force Fb. That is, the first elapsed time period Tboost is set to the first predetermined time period T1 so that the suction force F can become the static suction force Fb during the current holding period. Since the first target value Ihold1 is set to a value so that the static suction force Fb is greater than or equal to the required force Fa, the suction force F reaches the required force Fa before the suction force F is increased to the static suction force Fb.

The coil current is held to the second target value Ihold2 by the battery holding control after the time point t14 that the battery voltage Ubatt is applied to the first coil 14 instead of the boost voltage Uboost. The second target value Ihold2 is set to a value so that the suction force F increased by the increasing control and the holding control can be held. That is, the suction force F is held to the static suction force Fb during the battery holding period. The second elapsed time period Tpickup is set to the second predetermined time period T2 so that the lift amount can become a maximum value Lmax during the battery holding period.

The suction force F is decreased to a predetermined value during a time period from the time point t20 to the time point t30, and then is held to the predetermined value by the lift holding control. A lift position is held to the maximum value Lmax during a time period from the time point t20 to the time point t40. As shown in FIG. 4D, a max start time point tb may be more advanced than the time point t20, and a max end time point tc may be the same as the time point t40.

When the lift holding control is completed, the suction force F is started to be decreased, and the valve body 12 is started to be closed such that the lift amount is decreased. The seal surface 12*a* is attached to the seat surface 11*b* such that the valve body 12 is closed, at a time point td that the lift amount becomes zero. Since a reverse voltage is applied to the first coil 14 from the time point t40 to the time point t41, the coil current is decreased rapidly, and a closing responsivity of the valve body 12 is improved.

According to the present disclosure, the first target value Ihold1 may be changed according to an operation state of the internal combustion engine.

Hereafter, the meaning of changing the first target value Ihold1 will be described.

According to the increasing control and the holding control, the suction force is increased to the static suction force Fb during a time period from the first time point t10 to the time point t13. As a solid line shown in FIG. 6G, a first force increasing rate ΔFs and a second force increasing rate ΔFr vary according to the first target value Ihold1 during the current holding period.

Specifically, the first force increasing rate ΔFs is increased in accordance with an increase in the first target value Ihold1. Thus, the opening time point tas is advanced, and the injection delay time becomes shorter. Further, a core increasing rate of the movable core is increased. A first slope Δqs of the injection characteristic in the micro injection area becomes sharper. That is, in the micro injection area, when the energization time period Ti is extended by a predetermined period, the injection amount Qi becomes greater.

The second force increasing rate ΔFr is decreased in accordance with a decrease in the first target value Ihold1. Thus, the opening time point tar is retarded, and the injection delay time becomes longer. Further, the core increasing rate of the movable core is decreased. A second slope Δqs of the injection characteristic in the micro injection area becomes gentler. Furthermore, when the second force increasing rate ΔFr is decreased, a contacting rate which is a rate of the movable core for contacting the fixed core 13, and a collision sound is reduced.

Figure 7:
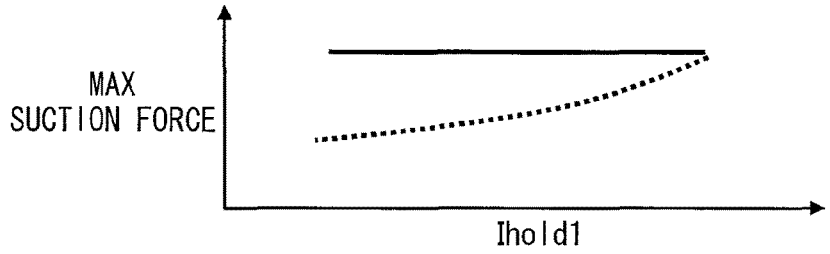
FIG. 7 is a graph showing a relationship between a max suction force and the first target value Ihold1, according to the embodiment.

A solid line shown in FIG. 7 shows a relationship between the first target value Ihold1 and a max suction force, according to the present disclosure. In this case, the max suction force corresponds to the static suction force Fb. According to the present disclosure, even though the first target value Ihold1 is changed, the max suction force is not changed when a predetermined period has elapsed as shown in FIG. 3. That is, even though the first target value Ihold1 is changed, the suction force can become the static suction force by extending the current holding period. Thus, the first target value Ihold1 can be changed without changing the max suction force.

A dotted line shown in FIG. 7 shows a relationship between the target peak value Ipeak and the max suction force according to a conventional technology where the coil current is decreased at a time point t20 that the coil current reaches the target peak value Ipeak. The smaller the target peak value Ipeak becomes, the smaller the max suction force becomes.

Figure 8:
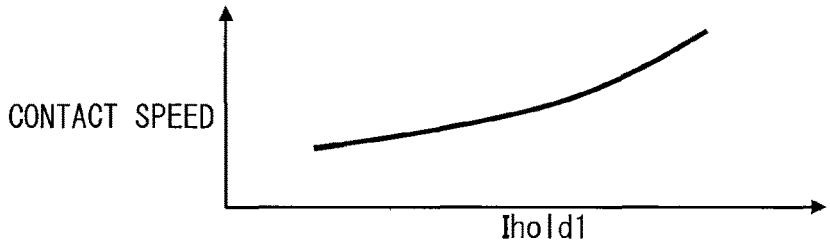
FIG. 8 is a graph showing a relationship between a contact speed of a movable core with respect to a fixed core and the first target value Ihold1, according to the embodiment.

FIG. 8 is a graph showing a relationship between a collision speed (contact speed) of the movable core with respect to the fixed core and the first target value Ihold1. The smaller the first target value Ihold1 becomes, the faster the contact speed becomes. Thus, as shown in FIG. 6G, the smaller the first target value Ihold1 becomes, the smaller the second force increasing rate ΔFr becomes. When the first target value Ihold1 is decreased, the contact speed can be slowed without lowering the max suction force, and the collision sound of the two cores can be reduced.

Figure 9:
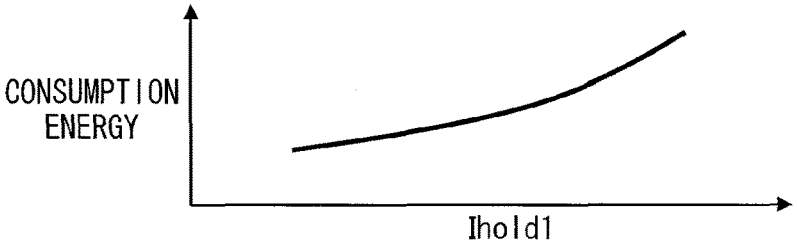
FIG. 9 is a graph showing a relationship between a consumption energy for energizing the coil and the first target value Ihold1, according to the embodiment.

FIG. 9 is a graph showing a relationship between a consumption energy for energizing the coil and the first target value Ihold1. Specifically, the consumption energy is a consumption amount of an electric power charged in a condenser 23*b*. The smaller the first target value Ihold1 becomes, the smaller the consumption energy becomes. Thus, the smaller the first target value Ihold1 becomes, the smaller the second force increasing rate ΔFr becomes. When the first target value Ihold1 is decreased, the consumption energy can be reduced without lowering the max suction force, and the capacity of the condenser 23*b* can be reduced.

Figure 10:
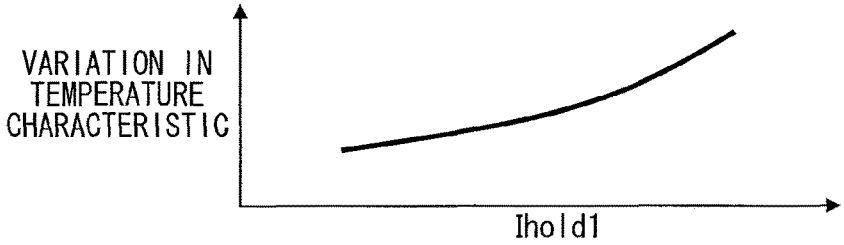
FIG. 10 is a graph showing a relationship between a variation in temperature characteristic and the first target value Ihold1, according to the embodiment.

FIG. 10 is a graph showing a relationship between a variation in temperature characteristic and the first target value Ihold1.

The higher a temperature (coil temperature) of the first coil 14 becomes, the greater a resistance (coil resistance) of the first coil 14 becomes. In this case, a current increasing rate ΔI of the coil current becomes smaller as a dotted line shown in FIG. 4B, and thereby a third force increasing rate ΔF of the suction force becomes smaller as a dotted line shown in FIG. 4C. The dotted lines in FIGS. 4B and 4C represent the coil current and the suction force, respectively, of when the coil temperature is high. Then, an opening valve start time point (injection start time point) ta becomes slower, and an opening valve time period Tact becomes shorter, as shown in FIG. 4D. Specifically, the opening valve start time point ta of when the coil temperature is normal is more advanced than a high-temperature injection start time point tah. Since the time point td is not changed, the opening valve time period Tact of when the coil temperature is normal is longer than the opening valve time period Tact of when the coil temperature is high. The dotted line in FIG. 4D represents the lift amount of when the coil temperature is high.

As a result, since the current increasing rate ΔI is changed according to the temperature characteristic of the coil current, the third force increasing rate ΔF, the opening valve start time point ta and the opening valve time period Tact are changed. The injection amount Qi relates to the opening valve time period Tact. That is, because the injection start time point ta and the injection amount Qi receive an affect of the temperature characteristic, a variation in injection state (temperature characteristic) causes with respect to the first time point t10 and the energization time period Ti.

As shown in FIG. 10, the smaller the first target value Ihold1 becomes, the smaller the variation in temperature characteristic becomes. Thus, the smaller the first target value Ihold1 becomes, the smaller the current increasing rate ΔI becomes. When the current increasing rate ΔI becomes gentler, an affect of a variation in the current increasing rate ΔI due to the coil temperature, which is applied to the second force increasing rate ΔFr, becomes smaller. Therefore, the variation in temperature characteristic becomes smaller. When the first target value Ihold1 is decreased, the variation in temperature characteristic can be reduced without lowering the max suction force, and a robustness of a control at the injection state can be improved.

When a multi-injection in which fuel is injected for multiple times in a single combustion cycle is executed, it is required that a small amount of fuel is accurately injected. In this case, since an affect of a time lag of the injection start time point to with respect to an amount lag of the injection amount is increased, an effect of the robustness may be remarkably expressed.

Figure 11:
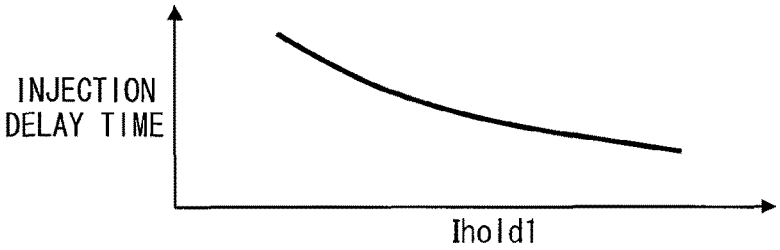
FIG. 11 is a graph showing a relationship between an injection delay time and the first target value Ihold1, according to the embodiment.

FIG. 11 is a graph showing a relationship between an injection delay time and the first target value Ihold1. The greater the first target value Ihold1 becomes, the shorter the injection delay time becomes. Thus, the greater the first target value Ihold1 becomes, the sharper the first force increasing rate ΔFs becomes. When the first target value Ihold1 becomes greater, the injection delay time can be shortened, and an injection responsivity can be improved.

For example, when an engine speed is fast, a time period (injection allow period) allowable for injecting is short in the single combustion cycle. In this case, an effect of reducing the injection delay time may be remarkably expressed.

According to FIGS. 7 to 11, the description below is suggested. When the first target value Ihold1 becomes smaller, the contact speed can be slowed, the consumption energy can be reduced, and the variation in temperature characteristic can be reduced, without lowering the max suction force. When the first target value Ihold1 becomes greater, the injection delay time can be shortened.

The microcomputer 21 changes the first target value Ihold1 according to the operation state of the internal combustion engine. Specifically, at S10 where the increasing control and the holding control are executed, the microcomputer 21 changes the first upper limit IH1 and the first lower limit ID so as to change the first target value Ihold1.

Figure 12:
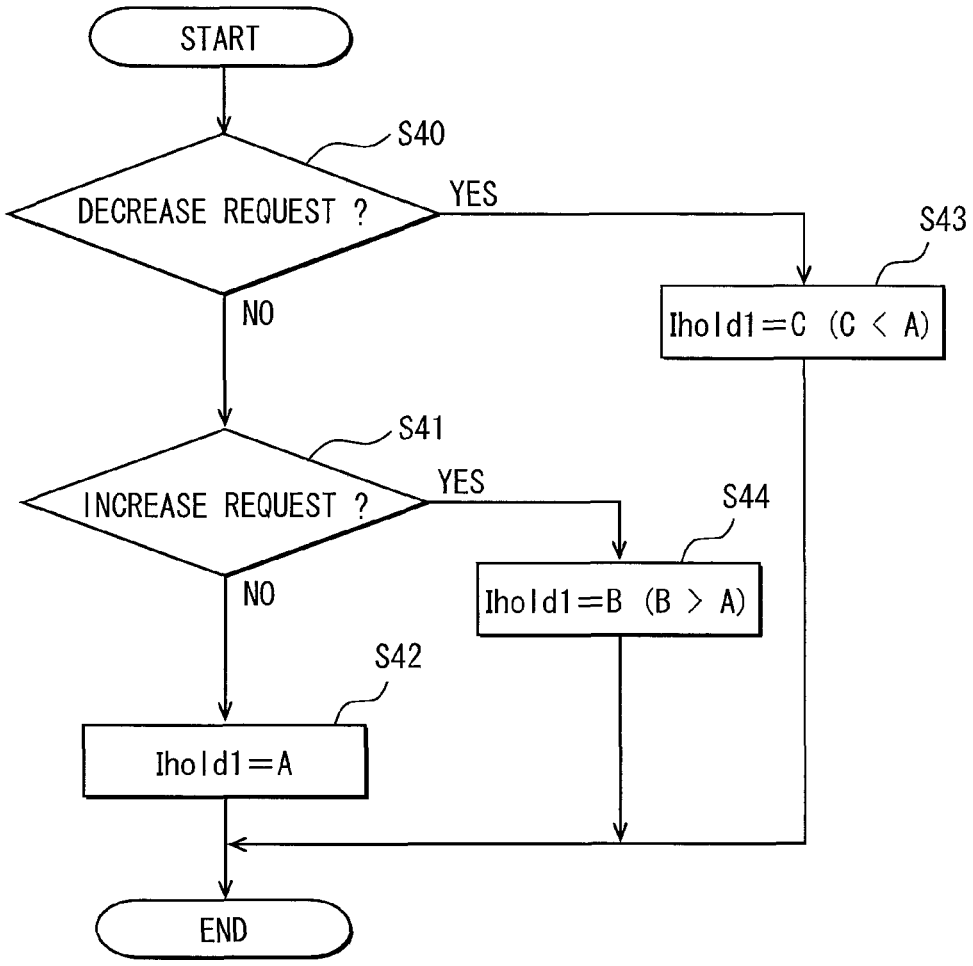
FIG. 12 is a flowchart showing a control for changing the first target value Ihold1.

FIG. 12 is a flowchart showing a control for changing the first target value Ihold1, and is executed by the microcomputer 21 at a predetermined time period. At S40, the microcomputer 21 determines whether a decrease request for lowering the first target value Ihold1 causes. The decrease request causes according to a sub routine executed by the microcomputer 21.

When the internal combustion engine is running at an idle operation state, the decrease request is caused. Alternatively, when the injection amount generated by opening and closing the valve body 12 for once is at a small injection state in which the injection amount is less than a predetermined amount, the decrease request is caused. For example, when fuel is injected at the micro injection area shown in FIG. 6G, the decrease request may be caused. In this case, the injection amount is determined to be at the small injection state. Alternatively, when the internal combustion engine is at an operation state where temperatures of various circuit components consisting of the ECU 20 are greater than or equal to a predetermined temperature, the decrease request is caused. In this case, the ECU 20 is referred to as a circuit 20. For example, when the engine speed or an engine load is greater than or equal to a predetermined value, the decrease request is caused. In this case, the temperatures of various circuit components are determined to be greater than or equal to the predetermined temperature.

When the microcomputer 21 determines that the decrease request has not caused, the microcomputer 21 proceeds to S41. At S41, the microcomputer 21 determines whether an increase request for increasing the first target value Ihold1 causes. The increase request causes according to a sub routine executed by the microcomputer 21. When the injection allow period is less than a predetermined time period in the single combustion cycle, the increase request is caused. For example, when the engine speed or an engine load is greater than or equal to a predetermined value, the decrease request is caused. In this case, the injection allow period is determined to be less than the predetermined time period. Alternatively, when the multi-injection is executed, it is preferable that the microcomputer 21 computes the injection allow period based on an injection number of times in the single combustion cycle, and causes the increase request.

When the microcomputer 21 determines that neither the decrease request nor the increase request is caused (S40: No, S41: No), the microcomputer 21 proceeds to S42. At S42, the microcomputer 21 sets the first target value Ihold1 to a normal value NA. As the solid lines shown in FIGS. 6G and 6H, the suction force, the injection amount, and the injection start time point are changed.

When the microcomputer 21 determines that the increase request is caused (S41: Yes), the microcomputer 21 proceeds to S44. At S44, the microcomputer 21 sets the first target value Ihold1 to an increase value NB which is greater than the normal value NA. According to the present disclosure, the processing in S44 corresponds to a changing portion. As the dotted lines ΔFs, Δqs and tas shown in FIGS. 6G and 6H, the suction force, the injection amount and the injection start time point are changed.

When the microcomputer 21 determines that the decrease request is caused (S40: Yes), the microcomputer 21 proceeds to S43. At S43, the microcomputer 21 sets the first target value Ihold1 to a decrease value NC which is less than the normal value NA. According to the present disclosure, the processing in S43 corresponds to the changing portion. As the dotted lines ΔFr, Δqr and tar shown in FIGS. 6G and 6H, the suction force, the injection amount and the injection start time point are changed.

According to the present disclosure, when both the increase request and the decrease request cause, the first target value Ihold1 may be not changed.

According to the present embodiment, the coil current is increased to the first target value Ihold1 by the increasing control and is held to the first target value Ihold1 for a predetermined time period the holding control. The first target value Ihold1 is changeable according to the operation state of the internal combustion engine. Therefore, an increasing rate (force increasing rate) of the suction force can be readily changed. Hereafter, an example for changing the first target value Ihold1 and effects of the example will be described.

When the internal combustion engine is running at the idle operation state, there is less need to shorten the injection delay time. In this case, the first target value Ihold1 becomes smaller, the contact speed can be slowed, the consumption energy can be reduced, and the variation in temperature characteristic can be reduced. When the injection amount is at the small injection state, the affect of the time lag of the injection start time point to with respect to the amount lag of the injection amount is increased. In this case, according to the present embodiment, since the first target value Ihold1 is decreased, the variation in temperature characteristic can be reduced.

When the force increasing rate is raised, temperatures of circuit components of the ECU 20 may become higher. For example, the microcomputer 21, the IC 22, the boost circuit 23, and switching elements SW2, SW3 and SW4 may have heat damage. According to the present embodiment, when the temperature of the circuit components is greater than or equal to a predetermined temperature, the first target value Ihold1 is decreased. Therefore, an increase in temperature of the circuit components can be restricted, and the heat damage can be canceled.

When the injection allow period is short, for example, when the engine speed is fast, the energization time period Ti may not be ensured if the injection delay period is long. According to the present embodiment, when the injection allow period is less than the predetermined time period, the first target value Ihold1 is increased. Therefore, the injection delay period can be shortened, and the energization time period Ti can be ensured.

Hereafter, features of the present embodiment will be described.

(1) The present embodiment has a first feature that the first target value Ihold1 is set to a value so that the static suction force Fb is greater than or equal to the required force Fa.

As shown in FIG. 4C, the suction force is increased to the static suction force Fb during the time period from the first time point t10 to the time point t13. A ratio of the first current increasing period to a first force increasing period from the first time point t10 to the opening valve start time point ta that the suction force reaches the required force Fa can be lowered.

For example, the higher the coil temperature becomes, the greater the coil resistance becomes. In this case, as dotted lines shown in FIGS. 4A and 4B, a second current increasing period from the first time point t10 to the time point t20 that the coil current reaches the target peak value Ipeak becomes longer. Therefore, the third force increasing rate ΔF becomes gentle as shown in FIG. 4C, the opening valve start time point ta becomes slower, and the opening valve time period Tact becomes shorter. The current increasing rate ΔI is changeable according to the temperature characteristic. Therefore, in the first current increasing period, the third force increasing rate ΔF is affected by the temperature characteristic. Since the coil current is held to the first target value Ihold1 in the current holding period, the third force increasing rate ΔF is not affected by the temperature characteristic in the current holding period.

Since the ratio of the first current increasing period to the first force increasing period can be lowered, a level for the third force increasing rate ΔF to receive the affect of the temperature characteristic can be lowered. As shown in FIGS. 6A to 6D, in a conventional controller, the coil current is lowered to a holding value (hold at a time point that the coil current reaches the target peak value Ipeak. Thus, a conventional current increasing period and a conventional force increasing period are the same to each other. In this case, a ratio of the conventional current increasing period to the conventional force increasing period is 100%. As shown in FIGS. 6A to 6D, a level for the conventional force increasing rate ΔF to receive the affect of the temperature characteristic is raised. For example, the dotted-dashed lines shown in FIGS. 6A to 6D show the conventional force increasing rate ΔF when the coil temperature is high.

According to the present embodiment, since a variation in the third force increasing rate ΔF due to the temperature characteristic can be lowered, a variation in the opening valve start time point ta and a variation in the opening valve time period Tact, which are varied in reliance on the temperature characteristic, can be restricted. A deterioration in accuracy of the injection state with respect to the first time point t10 and the energization time period Ti can be restricted, and the robustness of a control to the temperature characteristic can be improved.

(2) In the increasing control and the holding control, a voltage applied to the first coil 14 is controlled so that the valve body 12 is started to be opened in a time period that the coil current is held to the first target value Ihold1. That is, the voltage in the increasing control or a voltage apply time period of the voltage is controlled so that the valve body 12 is not opened in the increasing control. Further, a duty ratio in the holding control or the current holding period is controlled so that the valve body 12 is started to be opened in the holding control.

Thus, the valve body 12 is not opened in the increasing control, and the ratio of the first current increasing period to the first force increasing period can be certainly lowered.

(3) In the increasing control and the holding control, the boost voltage boosted by the boost circuit 23 is applied to the first coil 14. When the holding control is completed, the battery holding control in which the battery voltage is applied to the first coil 14 is executed so as to hold the coil current to the second target value Ihold2. The second target value Ihold2 is set to a value so that the suction force increased by the increasing control and the holding control can be held to the static suction force Fb.

When the current holding period becomes longer than necessary, a time period including the second current increasing period and the current holding period both using the boost voltage becomes longer, and the consumption energy may be increased at each injection. It is necessary that a capacity of the condenser 23*b* becomes greater.

According to the present embodiment, the battery holding control is executed after the holding control is executed. Since it is possible to hold the coil current to the second target value Ihold2 by the battery voltage after a time point that the coil current reaches the second target value Ihold2 by the boost voltage, the battery voltage is applied to the first coil 14 instead of the boost voltage. Therefore, the consumption energy can be reduced, and the condenser 23*b* can have a small capacity.

[Other Embodiment]

The present invention is not limited to the embodiments described above, but may be performed, for example, in the following manner. Further, the characteristic configuration of each embodiment can be combined.

(1) According to the embodiment, the first target value Ihold1 is changeable in three levels which are NA, NB and NC. However, the first target value Ihold1 may be freely changeable according to the operation state of the internal combustion engine.

(2) According to the embodiment, the battery holding control is executed after the holding control is executed so that the suction force is held to the static suction force Fb by the battery holding control. However, according to the present disclosure, the boost voltage is continued to be applied to the first coil 14 by the holding control to hold the suction force to the static suction force Fb without the battery holding control, even after the suction force reaches the static suction force Fb by the holding control.

(3) According to the embodiment, the second target value Ihold2 is set to a value less than the first target value Ihold1. However, the second target value Ihold2 may be set to a value equal to the first target value Ihold1.

(4) According to the embodiment, the first difference between the first upper limit IH1 and the first lower limit IL1 is set to a value equal to the second difference between the second upper limit IH2 and the second lower limit IL2. However, the first difference may be set to a value different from the second difference.

(5) As shown in FIG. 1, the fuel injector 10 is provided in the cylinder head 3. However, according to the present disclosure, the fuel injector 10 may be provided in a cylinder block. Further, according to the embodiment, the fuel injector 10 mounted on the internal combustion engine of the ignition type is used as a controlled subject. However, a fuel injector mounted on an internal combustion engine of a compression self-ignition type such as a diesel engine may be used as the controlled subject. Furthermore, the fuel injector 10 directly injecting fuel into the combustion chamber 2 is used as the controlled subject. However, a fuel injector injecting fuel into an intake pipe may be used as the controlled subject.

While the present disclosure has been described with reference to the embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A fuel injection controller for a fuel injector injecting fuel to be combusted in an internal combustion engine by an open-valve operation of the valve body according to an electromagnetic suction force generated by an energization of a coil, the fuel injection controller controlling an injection state of the fuel injector by controlling a coil current flowing through the coil, the fuel injection controller comprising:

an increasing control portion applying a boost voltage that is obtained by boosting the battery voltage to the coil to increase an average of the coil current to a first target value;

a first holding control portion applying the boost voltage to the coil to hold the average of the coil current increased by the increasing control portion to the first target value;

a second holding control portion applying the battery voltage to the coil to hold the average of the coil current to a second target value or a third target value; and a changing portion changing the first target value according to an operation state of the internal combustion engine, wherein target values of the average of the coil current includes the first target value, the second target value and the third target value, the second target value is less than the first target value, the third target value is less than the second target value, the increasing control portion and the first holding control portion controls the boost voltage applied to the coil to start to open the valve body in a time period where the average of the coil current is held to the first target value, the second holding control portion controls the battery voltage applied to the coil in a time period where the average of the coil current is held to the second target value before the open-valve operation is completed, and the second holding control portion controls the battery voltage applied to the coil in a time period where the average of the coil current is held to the third target value after the open-valve operation is completed.

2. A fuel injection controller according to claim 1, wherein the changing portion sets the first target value of when the internal combustion engine is running at an idle operation state to a value less than the first target value of when the internal combustion engine is running at other operation states.

3. A fuel injection controller according to claim 1, wherein the changing portion sets the first target value of when an injection amount generated by opening and closing the valve body for once is at a small injection state in which the injection amount is less than a predetermined amount to a value less than the first target value of when the injection amount is greater than or equal to the predetermined amount.

4. A fuel injection controller according to claim 1, wherein the changing portion sets the first target value of when an injection allow period allowable for injecting fuel in a single combustion cycle of the internal combustion engine is less than a predetermined time period to a value greater than the first target value of when the injection allow period is greater than or equal to the predetermined time period.

5. A fuel injection controller according to claim 1, wherein the changing portion sets the first target value of an operation state where a temperature of a circuit controlling the coil current is greater than or equal to a predetermined temperature is set to a value less than the first target value of an operation state where the temperature of the circuit is less than the predetermined temperature.

6. A fuel injection controller according to claim 1, wherein the electromagnetic suction force required for starting to open the valve body is referred to as a required opening force, the electromagnetic suction force saturated by holding the average of the coil current to the first target value is referred to as a static suction force, and the first target value is set to a value so that the static suction force is greater than or equal to the required opening force.

7. A fuel injection controller according to claim 1, further comprising:

a boost circuit boosting the battery voltage to the boost voltage; and a battery holding control portion applying the battery voltage to the coil to hold the average of the coil current to a second target value after the second holding control portion is executed, wherein the increasing control portion and the first holding control portion applies the boost voltage boosted by the boost circuit to the coil, and the second target value is set to a value where the electromagnetic suction force which is increased by the increasing control portion and the second holding control portion can be held.

8. A fuel injection system comprising:

a fuel injection controller according to claim 1; and the fuel injector.

9. A fuel injection controller according to claim 1, wherein the first holding control portion performs holding control by controlling a duty ratio of the boost voltage applied to the coil to hold the average of the coil current so that the valve body is started to be opened in the holding control.

10. A fuel injection controller according to claim 1, wherein the valve body is not opened when the increasing control portion applies the boost voltage to the coil to increase the average of the coil current to the first target value.

11. A fuel injection controller for a fuel injector injecting fuel to be combusted in an internal combustion engine by an open-valve operation of the valve body according to an electromagnetic suction force generated by an energization of a coil, the fuel injection controller controlling an injection state of the fuel injector by controlling a coil current flowing through the coil, the fuel injection controller comprising:

a computer, including a processor and a memory, the computer being configured to at least perform:

an increasing control including applying a boost voltage that is obtained by boosting a battery voltage to the coil to increase an average of the coil current to a first target value;

a first holding control including applying the boost voltage to the coil to hold the average of the coil current increased by the increasing control to the first target value;

a second holding control applying the battery voltage to the coil to hold the average of the coil current to a second target value or a third target value; and a changing control including changing the first target value according to an operation state of the internal combustion engine; wherein target values of the average of the coil current includes the first target value, the second target value and the third target value, the second target value is less than the first target value, the third target value is less than the second target value;

the increasing control and the holding control controls the boost voltage applied to the coil to start to open the valve body in a time period where the average of the coil current is held to the first target value; and the second holding control controls the battery voltage applied to the coil in a time period where the average of the coil current is held to the second target value before the open-valve operation is completed, and the second holding control controls the battery voltage applied to the coil in a time period where the average of the coil current is held to the third target value after the open-valve operation is completed.

12. A fuel injection controller according to claim 11, wherein the changing control sets the first target value of when the internal combustion engine is running at an idle operation state to a value less than the first target value of when the internal combustion engine is running at other operation states.

13. A fuel injection controller according to claim 11, wherein the changing control sets the first target value of when an injection amount generated by opening and closing the valve body for once is at a small injection state in which the injection amount is less than a predetermined amount to a value less than the first target value of when the injection amount is greater than or equal to the predetermined amount.

14. A fuel injection controller according to claim 11, wherein the changing control sets the first target value of when an injection allow period allowable for injecting fuel in a single combustion cycle of the internal combustion engine is less than a predetermined time period to a value greater than the first target value of when the injection allow period is greater than or equal to the predetermined time period.

15. A fuel injection controller according to claim 11, wherein the changing control sets the first target value of an operation state where a temperature of a circuit controlling the coil current is greater than or equal to a predetermined temperature is set to a value less than the first target value of an operation state where the temperature of the circuit is less than the predetermined temperature.

16. A fuel injection controller according to claim 11, wherein the electromagnetic suction force required for starting to open the valve body is referred to as a required opening force, the electromagnetic suction force saturated by holding the average of the coil current to the first target value is referred to as a static suction force, and the first target value is set to a value so that the static suction force is greater than or equal to the required opening force.

17. A fuel injection controller according to claim 11, wherein the first holding control includes controlling a duty ratio of the boost voltage applied to the coil to hold the coil current so that the valve body is started to be opened in the first holding control.

18. A fuel injection controller according to claim 11, wherein the valve body is not opened during the increasing control.

19. A fuel injection system comprising:

a fuel injection controller according to claim 11; and the fuel injector.

20. A fuel injection controller according to claim 7, wherein the second target value is a current value lower than the first target value.

21. A fuel injection controller according to claim 7, wherein the battery holding control portion holding the average of the coil current to the second target value applies the battery voltage, which is lower than the boost voltage applied to the coil by the first holding control portion in the time period where the average of the coil current is held to the first target value, to the coil.

22. A fuel injection controller according to claim 1, wherein the coil current is held to have a first value of when the coil current increased by the increasing control portion starts to be firstly decreased by the first holding control portion, and a second value of when the coil current decreased by the first holding control portion starts to be increased by the first holding control portion immediately before an end of the time period, and the first value is higher than the second value.

23. A fuel injection controller according to claim 22, wherein the increasing control portion and the first holding control portion control the boost voltage applied to the coil to start to open the valve body after a time point that the coil current becomes the first value.

24. A fuel injection controller according to claim 1, further comprising:

a period changing portion changing a holding time period according to the first target value, wherein the time period where the average of the coil current is held to the first target value is expressed as the holding time period.

* * * * *